US006733588B2

(12) United States Patent
Stefani

(10) Patent No.: US 6,733,588 B2
(45) Date of Patent: May 11, 2004

(54) DEVICE FOR SUPPLYING GLAZE IN ROTARY MACHINES FOR DECORATION OF CERAMIC TILES

(75) Inventor: Franco Stefani, Sassuolo (IT)

(73) Assignee: Syfal SpA, Sassuolo (IT)

( * ) Notice: Subject to any disclaimer, the term of this patent is extended or adjusted under 35 U.S.C. 154(b) by 0 days.

(21) Appl. No.: 10/638,427

(22) Filed: Aug. 12, 2003

(65) Prior Publication Data

US 2004/0060507 A1 Apr. 1, 2004

(30) Foreign Application Priority Data

Sep. 27, 2002 (IT) ..... MO2002A0272

(51) Int. Cl.[7] ..... B05C 1/02
(52) U.S. Cl. ..... 118/261; 427/428
(58) Field of Search ..... 118/259, 261; 427/128

(56) References Cited

U.S. PATENT DOCUMENTS 5,476,545 A * 12/1995 Schrauwers et al. ..... 118/668
5,849,082 A * 12/1998 Stefani ..... 118/212

* cited by examiner

*Primary Examiner*—Laura Edwards
(74) *Attorney, Agent, or Firm*—Young & Thompson

(57) ABSTRACT

On a mobile rest plane, the following operate: a matrix-bearing cylinder, rotatable about an axis thereof, and at least a doctor predisposed to operate contactingly with an external surface of the matrix-bearing cylinder. A supply of glaze is directed into a chamber delimited between the doctor and a portion of external cylindrical surface of the cylinder facing the doctor, at a position in which the doctor and the surface are in contact, via a flexible conduit terminating at a discharge end thereof which is positioned superiorly of the chamber and which is commanded to perform an alternating motion. The flexible conduit is supported by an articulated chain which is commanded to slide axially in two directions along a guide.

3 Claims, 1 Drawing Sheet

DEVICE FOR SUPPLYING GLAZE IN ROTARY MACHINES FOR DECORATION OF CERAMIC TILES

BACKGROUND OF THE INVENTION

Specifically, though not exclusively, the invention is usefully applied in rotary machines of the type in which a matrix-bearing cylinder, mobile in rotation about an axis thereof, operates on a mobile rest plane on which tiles are translated in a predetermined direction, with at least one doctor predisposed to operate in contact with the external surface of the cylinder. In the present embodiment the matrix-bearing cylinder is provided with at least one elastically-deformable peripheral part limited by a smooth external cylindrical surface made of an elastomer material on which a shape is recessed, constituting the matrix.

In these machines, the supply of glaze is normally directed into a chamber delimited between the doctor and the portion of external cylindrical surface facing the doctor at the contact line there-between.

An important problem exhibited by this type of rotary machine concerns making sure that the supply of fresh glaze is continuous and uniform along the whole length of the doctor.

The main aim of the present invention is to provide a simple and effective solution to this problem.

An advantage of the invention is that it uses the same motor which commands the alternating oscillation motion of the doctor.

These aims and advantages and more besides are all attained by the invention as it is characterized in the appended claims.

SUMMARY OF THE INVENTION

On a mobile rest plane, the following operate: a matrix-bearing cylinder, rotatable about an axis thereof, and at least a doctor predisposed to operate contactingly with an external surface of the matrix-bearing cylinder. A supply of glaze is directed into a chamber delimited between the doctor and a portion of external cylindrical surface of the cylinder facing the doctor, at a position in which the doctor and the surface are in contact, via a flexible conduit terminating at a discharge end thereof which is positioned superiorly of the chamber and which is commanded to perform an alternating motion. The flexible conduit is supported by an articulated chain which is commanded to slide axially in two directions along a guide.

BRIEF DESCRIPTION OF THE DRAWINGS

Further characteristics and advantages of the present invention will better emerge from the detailed description that follows, of a preferred but non-limiting example of the invention, in a preferred but non-exclusive embodiment thereof, illustrated by way of example in the accompanying figures of the drawings, in which.

DESCRIPTION OF THE PREFERRED EMBODIMENTS

Figure 2:
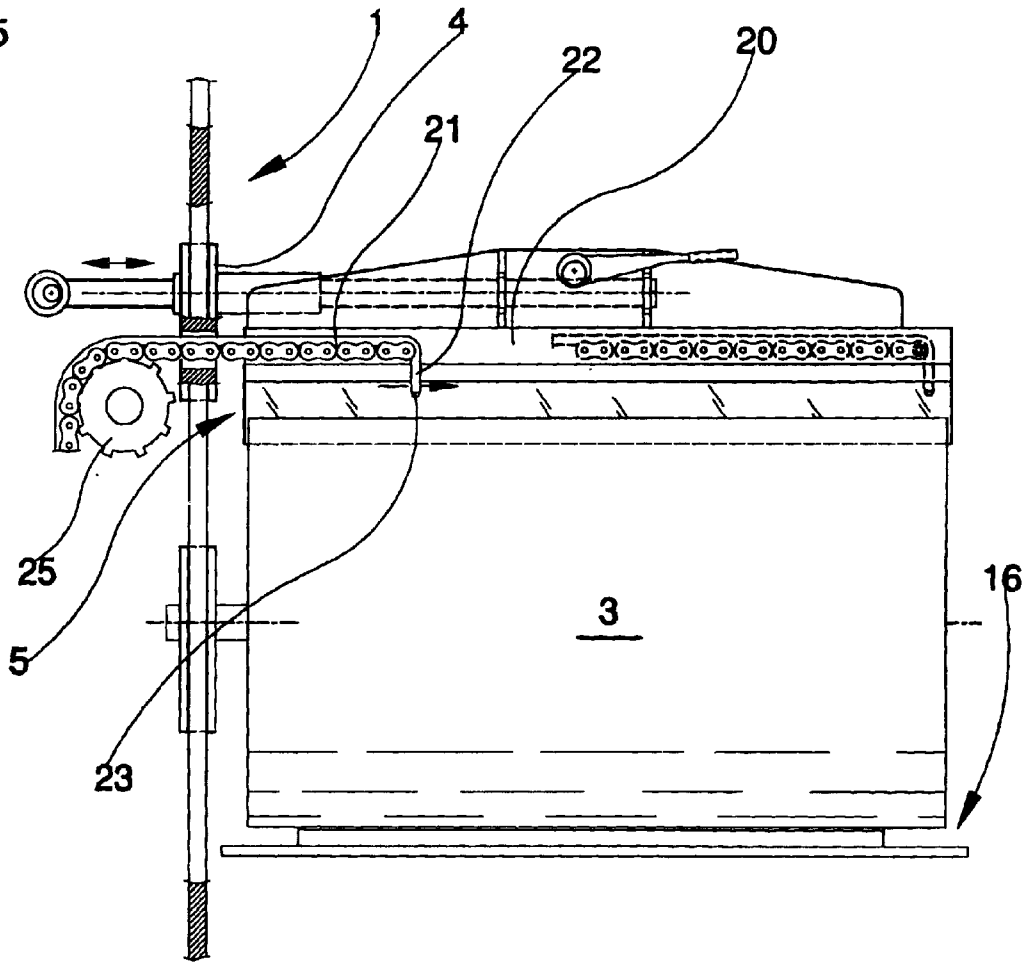
FIG. 2 is a schematic lateral view from the left of FIG. 1.
Figure 1:
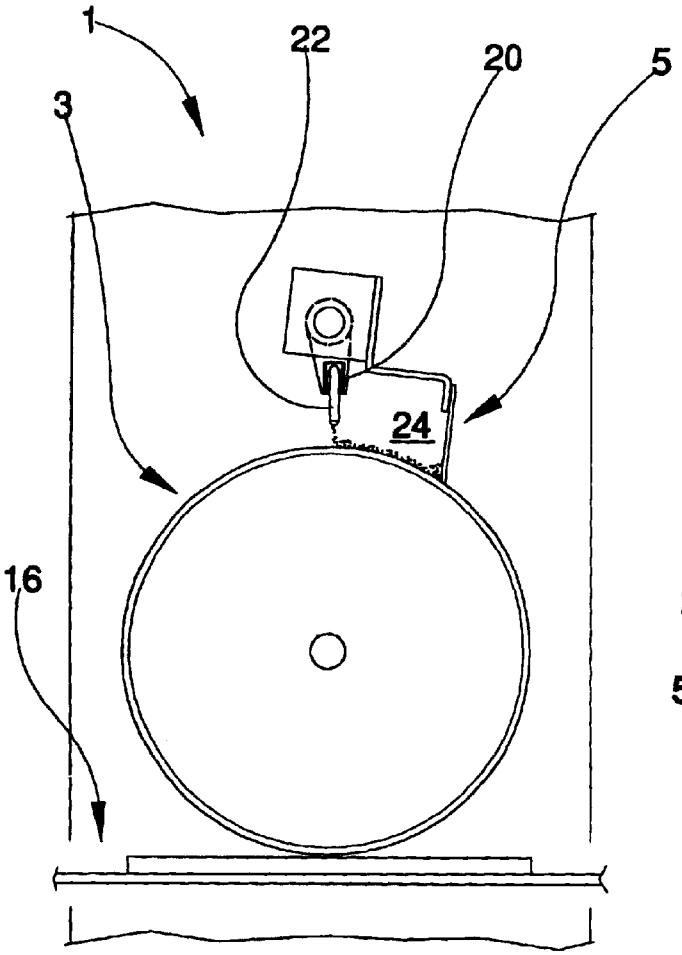
FIG. 1 is a schematic front view in vertical elevation.

With reference to the figures of the drawings, 1 schematically denotes a vertically-developing frame of a rotary machine for decoration of ceramic tiles, of a type in which tiles are translated in a predetermined direction on a mobile rest plane 16, on which a matrix-bearing cylinder 3 operates, which cylinder 3 is rotatingly mobile about an axis thereof, with at least one doctor being predisposed to operate contactingly on the external surface of the matrix-bearing cylinder 3. The cylinder 3 is provided with at least one elastically-deformable peripheral part delimited by a smooth external cylindrical surface, made of an elastomer material and on which a shape has been cut, or recessed; this is the matrix.

A slide 4 slides in a vertical direction on the frame 1, on which slide 4 a doctor 5 is supported, together with organs which support the doctor 5 and which command any operational motion of the doctor (5) (oscillating motion).

A guide 20 is solidly constrained on the slide 4, parallel to the doctor 5, which guide 20 extends for at least the entire length of the doctor 5 and which guide 20 is located above the part of doctor 5 which comes into contact with the external cylindrical surface of the matrix-bearing cylinder 3.

A flexible element is slidably coupled along the guide 20, which flexible element supports at least one flexible conduit 22 for supply of glaze.

The flexible element 22 ends at a discharge end 23 of the glaze which remains positioned above the chamber 24 which is delimited and comprised between the doctor 5 and the portion of external cylindrical surface of the matrix-bearing cylinder 3 facing the doctor 5 at the relative contact zone thereof.

The flexible element 22 is partially wound about and solidly coupled in rotation on a drive wheel 25 activated to rotate in two directions. In particular, the flexible element is constituted by an articulated chain 21 predisposed to mesh with a cogging provided on the periphery of the drive wheel 25. The drive wheel is driven, via a belt transmission, not shown in the figures of the drawings, by a step motor which is supported, together with the doctor 5, on the slide 4. The step motor also produces the oscillating motion of the doctor 5.

The alternating rotating motion of the drive wheel 25 is transformed into the alternating straight motion of the chain 21 and consequently of the discharge end 23 of the glaze in the flexible conduit 22.

There is thus a continuous supply of fresh glaze, uniform along the whole length of the doctor 5. This is a considerable improvement on the prior art in terms of remixing of glaze and making the glaze uniform along the whole length of the matrix and the underlying tile to be decorated.

What is claimed is:

1. A device for supplying glaze in rotary machines for decoration of ceramic tiles, of a type where, on a mobile rest plane on which the tiles are translated in a predetermined direction, the following operate: a matrix-bearing cylinder, mobile in rotation about an axis thereof, which matrix-bearing cylinder is provided with at least an elastically-deformable peripheral part having a smooth external cylindrical surface made of an elastomer material, on which smooth external cylindrical surface a shape is cut and recessed, which shape is a matrix; at least a doctor predisposed for operating in contact with the external surface of the matrix-bearing cylinder; a supply of glaze being contained in a chamber delimited between the at least a doctor and a portion of the external cylindrical surface of the cylinder facing the doctor in a relative zone of contact there-between; wherein it comprises:

a guide which is parallel to the doctor, which guide extends for at least an entire length of the at least a doctor and which guide is located superiorly to a part of the at least a doctor which part is destined to come into contact with the external cylindrical surface of the matrix-bearing cylinder;

a flexible element which is destined to slide along the guide and to support at least a flexible conduit for supply of glaze, which flexible conduit terminates in a discharge end which is located superiorly to the chamber; the flexible element being partially wound about and partially coupled in rotation on a drive wheel which can rotate in two directions.

2. The device of claim 1, wherein the flexible element is an articulated chain which is predisposed to mesh with a cogging exhibited peripherally on the drive wheel.

3. The device of claim 2, wherein the drive wheel is powered by a step motor which is supported, together with the at least a doctor, to a slide which is constrained to a frame, which slide can slide in a vertical direction with respect to the wheel.

* * * * *